US006526956B1

(12) United States Patent
Hankins

(10) Patent No.: US 6,526,956 B1
(45) Date of Patent: Mar. 4, 2003

(54) ARCHERY BOW ATTACHMENT

(76) Inventor: Robert Jordan Hankins, 31 E. 1st St., Sheridan, WY (US) 82801

( * ) Notice: Subject to any disclaimer, the term of this patent is extended or adjusted under 35 U.S.C. 154(b) by 0 days.

(21) Appl. No.: 09/784,821

(22) Filed: Feb. 20, 2001

(51) Int. Cl.[7] ..... F41B 5/14
(52) U.S. Cl. ..... 124/86; 124/89; 396/429
(58) Field of Search ..... 124/23.1, 25.6, 124/86, 88, 89; 396/429

(56) References Cited

U.S. PATENT DOCUMENTS 4,296,725 A * 10/1981 Broderick ..... 124/23.1
4,643,159 A 2/1987 Ryan
4,890,128 A * 12/1989 Kania
5,611,324 A 3/1997 Kursinsky ..... 124/86
5,844,604 A * 12/1998 Myeong
6,286,796 B1 * 9/2001 Pugliesi ..... 124/88 X

* cited by examiner

*Primary Examiner*—John A. Ricci
(74) *Attorney, Agent, or Firm*—Salzman & Levy

(57) ABSTRACT

An archery apparatus for viewing and recording the continuous trajectory of the flight of an arrow released from a complex archery bow that has a vibration damping rod extending therefrom. A movie or video camera is mounted on the distal end of the vibration damping rod. The camera is aligned with the line of sight of the target. The camera records the arrow trajectory after release of the arrow from the bow. The archery bow is operative in either one of two modes: (a) a target shooting mode, or (b) a hunting mode.

9 Claims, 3 Drawing Sheets

ARCHERY BOW ATTACHMENT

FIELD OF THE INVENTION

The present invention relates to archery attachments and, more particularly, to a complex archery bow with video or movie camera attachments.

BACKGROUND OF THE INVENTION

It has been suggested to mount a single-shot camera to an archery bow, in order to take a picture of the hunted animal or target. A bow and camera combination is described in U.S. Pat. Nos. 5,611,324 and 4,643,159.

In the U.S. Pat. No. 5,611,324, issued on Mar. 18, 1997, to Kursinsky, for CAMERA ACTUATING ARCHERY APPARATUS, an archery bow is shown having eccentric cams mounted upon distal ends thereof. The bowstring is carried upon the distally mounted cams. A single-shot camera is mounted upon the grip of the bow. A string attached to the arrow is connected to a trigger mechanism mounted upon the camera. Release of the arrow from the bow actuates the trigger mechanism that activates the camera.

In U.S. Pat. No. 4,643,159, issued to Ryan on Feb. 17, 1987, for AUTOMATIC CAMERA ACTUATING APPARATUS FOR AN ARCHERY BOW, a camera is shown mounted to the grip of an archery bow. The camera is automatically actuated, either by an electric eye or a limit switch mounted upon the bow, and responds to the release of the bowstring.

The purpose of the present invention is to record the entire trajectory of the flight of an arrow to its target. This represents a significant improvement over a single-shot or "still" camera that is limited to only one or perhaps a few static images of the flight of the arrow.

It has been determined that having means to view the actual, continuous flight of the arrow gives the archer a great deal of information about the shot and the shooting technique.

In addition, it has been determined that the average archer derives a great deal of pleasure in watching the flight of the arrow. This is so because in actual competitions and in hunting, the archer cannot actually see the mechanics of flight. Having a flight recording of the arrow trajectory allows the archer to study and enjoy his skill. The use of slow motion and frame freezing provides for observation of minute details of the trajectory, further enhancing the enjoyment and learning process.

The current invention features a movie or video camera that is mounted to a complex archery bow. The camera is mounted upon the end of the vibration damping rod of the archery bow. In one embodiment of the invention, a trembler switch is electrically connected to the camera activation circuit. Release of the arrow from the bow causes the damping rod to vibrate, thus causing the trembler switch to activate the video camera. In an alternate embodiment, the camera can be manually activated to film or record a moving target prior to the release of the arrow from the bow.

SUMMARY OF THE INVENTION

In accordance with the present invention, there is provided an archery apparatus for viewing and recording the trajectory of the flight of an arrow released from an archery bow. The bow may be a simple, complex or cross bow. The archery apparatus comprises a complex archery bow having a vibration damping rod extending therefrom. A movie or video camera is mounted on the distal end of the vibration damping rod, which is aligned with the line of sight of the target. The camera in one embodiment of the invention comprises a trembler switch that is electrically connected to the activating circuit that starts the camera. Release of the arrow causes the bow to vibrate and the damping rod vibrating as it dampens the bow vibrations. Vibration of the damping rod actuates the trembler switch, which causes the camera to start and record the trajectory of the flight of the arrow. For actual hunting, the camera can be manually started prior to arrow release, in order to track movement of the prey.

A counterbalance may be provided on the bow above a horizontal axis thereof when the camera is mounted below the axis. Moreover, in another embodiment, to reduce both weight and potential viewing obstruction, only a camera lens or "eyecam" need be mounted on the bow and connected to a video pack, via an electric cord or fibre optic cable, worn on the archer's belt.

It is an object of this invention to provide an improved archery apparatus for viewing an archery shot.

It is another object of the invention to provide an archery apparatus for recording the actual trajectory of an arrow that is released from an archery bow.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components will bear the same designation or numbering throughout the figures.

DESCRIPTION OF THE PREFERRED EMBODIMENT

Generally speaking, the invention features an archery apparatus for viewing and recording the trajectory of the flight of an arrow released from an archery bow, which may be a complex, simple or cross bow. In one embodiment, the archery apparatus comprises an archery bow having a vibration damping rod extending therefrom. A movie or video camera is mounted on the distal end of the vibration damping rod. The camera is aligned with the line of sight of the target. The camera records the arrow trajectory after release of the arrow from the bow.

Figure 2:
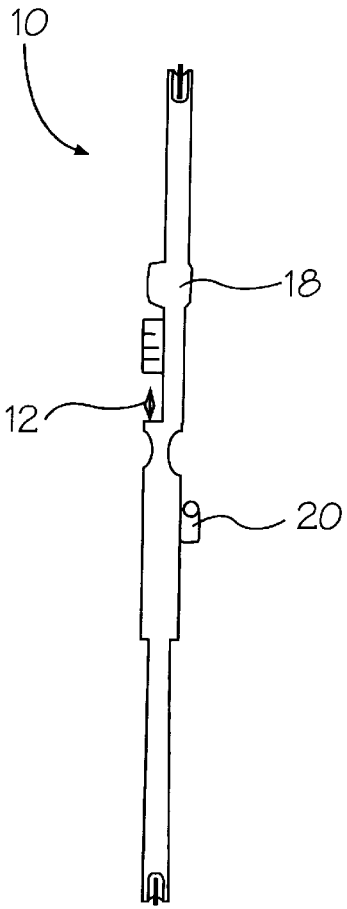
FIG. 2 depicts an end view of the arrow, archery bow, and camera shown in FIG. 1.
Figure 1:
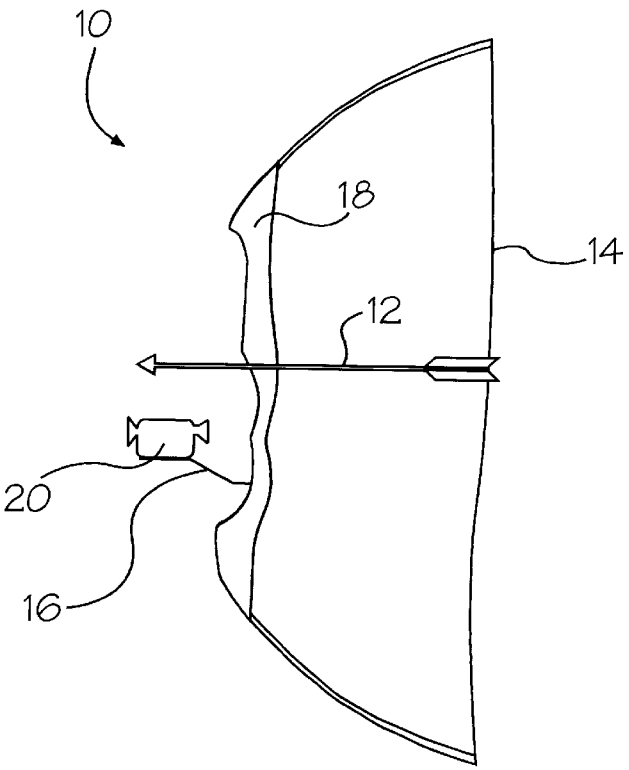
FIG. 1 illustrates a schematic plan view of an arrow being prepared to be released from a complex archery bow, upon which a movie or video camera has been mounted in order to record the arrow trajectory.

Now referring to FIGS. 1 and 2, an archery bow 10 is shown, with an arrow 12 mounted upon the bowstring 14. The complex archery bow 10 depicted in these FIGURES has a dampening rod 16 attached to the archery bow grip 18. Usually, the dampening rod 16 comprises a weight 22 (see FIGS. 4*a* through 4*c*) mounted on its distal end. In one embodiment of this invention, the weight can be removed, and a movie or video camera 20 can be attached to the dampening rod 16 in the place of the weight 22. In another embodiment, the movie or video camera 20 can be mounted to the weight 22. The camera 20 should be small, and of sufficient weight to be compatible with that needed to provide the necessary dampening function.

Figure 4A:
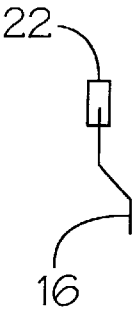
FIGS. 4*a* through 4*c* illustrate three different damping rod configurations for use in the complex archery bow shown in FIG. 1.
Figure 4B:
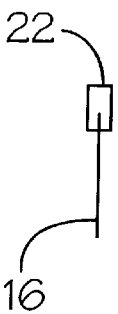
Figure 4C:
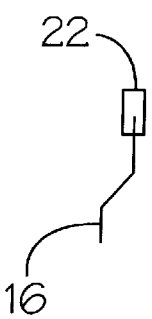

Referring to FIGS. 4*a* through 4*c*, three different dampening rods 16 are shown. Each dampening rod 16 has a weight 22 mounted on its distal end. The camera 20 can be mounted to the right, left, or in-line with the grip 18. The dampening rod 16 shown in FIG. 4*a* mounts the weight 22 to the left of the vertical plane of the bow 10. The dampening rod 16 depicted in FIG. 4*c* mounts the weight 22 to the right of the vertical plane of the bow 10. The dampening rod 16 illustrated in FIG. 4*b* mounts the weight 22 in alignment with the vertical plane of the bow 10. In similar fashion, as aforementioned, the camera 20 can be aligned with respect to bow 10.

During target tournaments, the camera 20 can be automatically started when the arrow 12 is released from the bowstring 14, to record the continuous trajectory of the flight of the arrow 12.

During hunting, when time is of the essence, the camera 20 can be manually started prior to the release of the arrow 12, so that the animal or prey can be filmed or taped before, during, and after being struck by the arrow 12.

Figure 3:
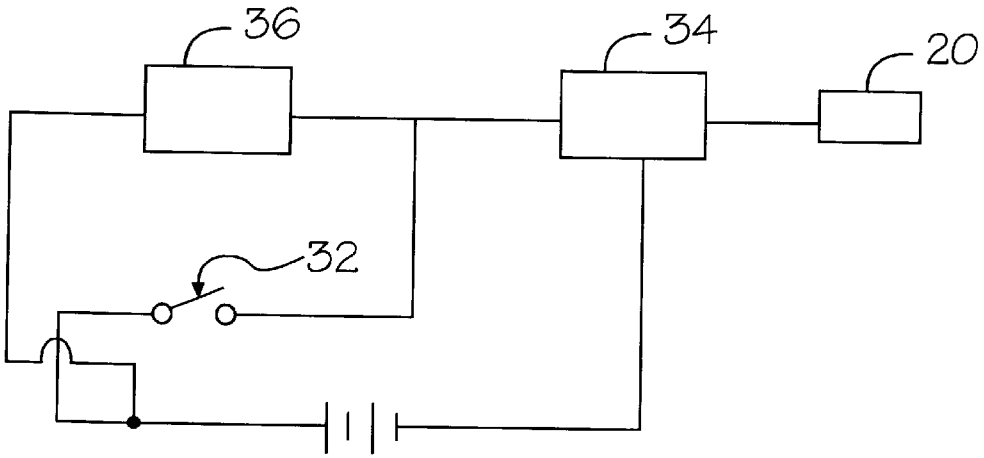
FIG. 3 shows a schematic circuit for triggering the actuation of the camera mounted upon the bow of FIG. 1 in both an automatic and a manual mode.

Activation of the camera 20 is explained with reference to the electrical circuit 30 shown in FIG. 3. Circuit 30 allows the camera 20 to be actuated in one of two different modes. In a first or hunting mode, the camera 20 is manually started prior to release of the arrow 12 from the bowstring 14, by a switch 32. Closing switch 32 allows current to flow to an actuation circuit 34 that starts the camera 20. In a second or target shooting mode, the camera 20 can comprise a trembler switch 36. The trembler switch 36 is integral with the camera 20. It will be caused to close when the arrow 12 is released from the bow 10. During the release of the arrow 12, the dampening rod 16 begins to vibrate, thus closing the trembler switch circuit. The trembler switch circuit will supply current to activate the circuit 34, thus starting the camera 20.

The camera 20 can be mounted to weight 22 by means of a strap or other fixture. The camera 20 can also be mounted directly to dampening rod 16 by means of a screw fastener or by means of a universal-type fixture, etc.

Figure 5:
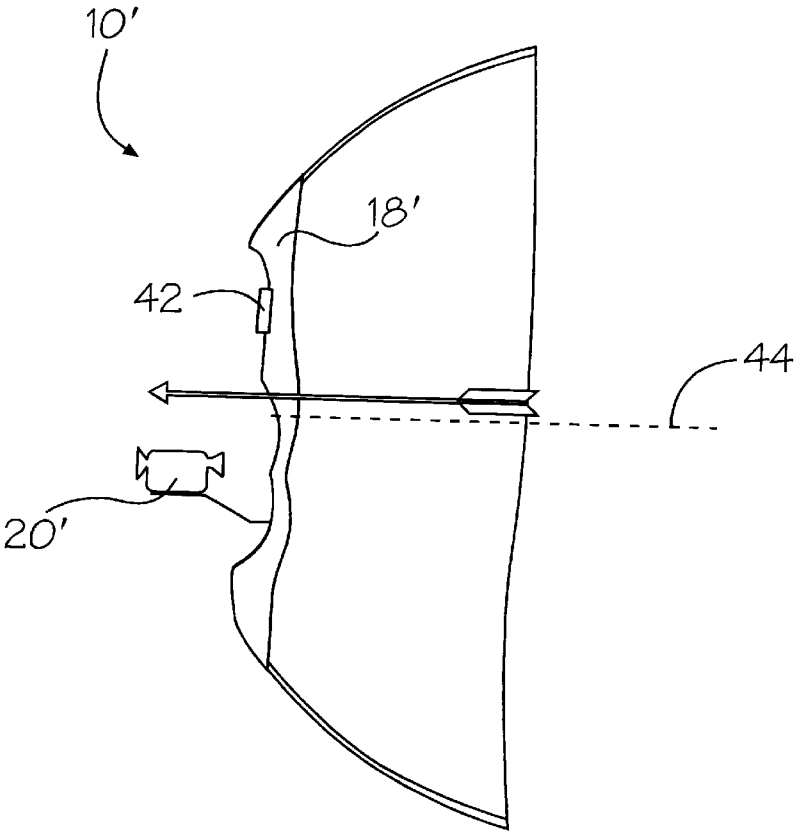
FIG. 5 depicts a schematic plan view of a complex archery bow with a counterbalance in accordance with another aspect of the present invention.

Referring now to FIG. 5, archery bow 10' of another embodiment includes an additional weight 42 which is added to the archery bow grip 18' above a horizontal axis 44 of the bow 10' to stabilize the complex archery bow 10' by counterbalancing movie or video camera 20' which is mounted on grip 18' below axis 44. In this way, the bow 10' remains in balance and stabilized, which is beneficial not only for handling, aiming and shooting, but also to provide a more vibration-free platform for the camera 20' mounted on the bow grip 18'.

Figure 6:
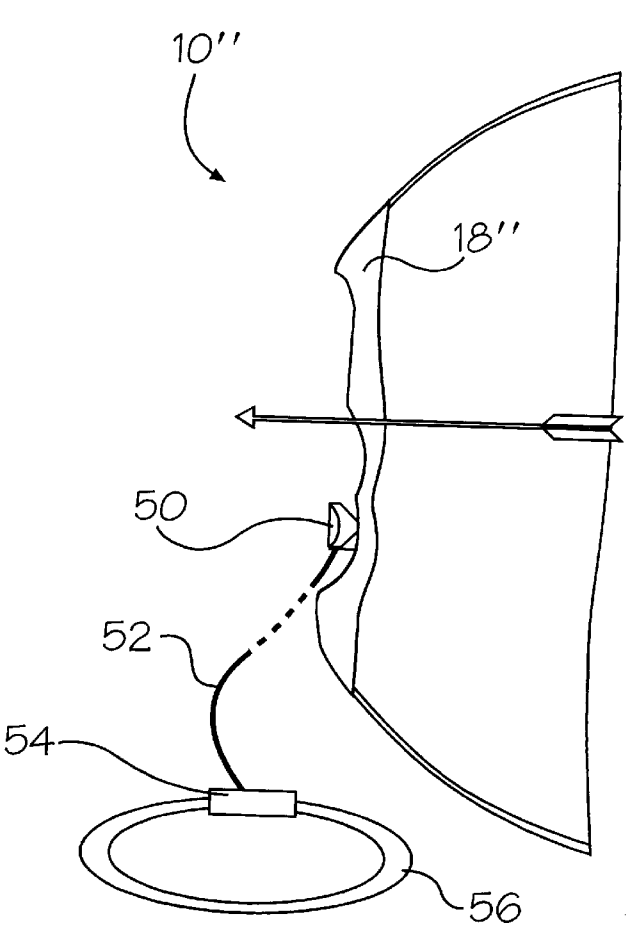
FIG. 6 depicts a schematic plan view of an archery bow and belt combination for separating a camera lens from its associated video pack.

Referring now also to FIG. 6, an alternate embodiment is shown in which only a camera lens 50 or similar optics (e.g., a CCD device) is mounted by conventional means to bow grip 18". The lens 50 is, of course, lighter than a conventional, self-contained camera, which results in the archery bow 10" being of substantially the same weight as a bow without such lens 50. Another advantage of mounting only the camera lens 50 to the bow grip 18" is less likelihood of distraction or view obstruction to the archer.

Connected to lens 50 by means of an electric cord or fibre optic cable 52 is a video pack 54 that may be worn by the archer on his belt 56, backpack, or other suitable item of clothing. The lens 50 and video pack 54 constitute a so-called eyecam, which accomplishes the same function as that of the aforementioned embodiments of the invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An archery apparatus for recording the continuous flight trajectory of an arrow released from a bow, said archery apparatus comprising:

a bow having a string for release of an arrow along a flight trajectory;

a vibration dampening rod mounted to said bow, a camera mounted to said vibration dampening rod for recording the flight trajectory of an arrow; and a trembler switch and actuating circuit that is electrically connected to said camera, wherein said camera is actuated with release of an arrow from said bow.

2. The archery apparatus in accordance with claim 1, wherein said bow comprises a complex archery bow.

3. The archery apparatus in accordance with claim 1, wherein said camera is a movie camera.

4. The archery apparatus in accordance with claim 1, wherein said camera is a video camera.

5. The archery apparatus in accordance with claim 1, wherein said camera has means for operating in one of two modes: a target shooting mode, and a hunting mode.

6. The archery apparatus in accordance with claim 1, further comprising a counterbalance attached to said archery bow for stabilizing said bow.

7. An archery apparatus for recording the continuous flight trajectory of an arrow released from a bow, said archery apparatus comprising:

a bow having a string for release of an arrow along a flight trajectory;

a vibration dampening rod mounted to said bow;

a video camera lens mounted to said vibration dampening rod for recording the flight trajectory of an arrow;

a video pack operatively connected to and spaced apart from said video camera lens for recording an image generated thereby; and a trembler switch and actuating circuit that is electrically connected to said video pack, wherein said video pack is actuated with release of an arrow from said bow.

8. The archery apparatus in accordance with claim 7, wherein said video pack has means for operating in one of two modes: a target shooting mode, and a hunting mode.

9. The archery apparatus in accordance with claim 7, further comprising a belt to be worn by an archer and wherein said video pack is carried by said belt.

* * * * *